United States Patent [19]

Klug et al.

[11] Patent Number: 4,709,668

[45] Date of Patent: Dec. 1, 1987

[54] SELF-ADJUSTING HYDRAULIC VALVE TAPPET

[75] Inventors: Horst Klug; Wolfgang Mocker; George Schaeffler, all of Herzogenaurach; Walter Speil, Ingolstadt, all of Fed. Rep. of Germany

[73] Assignee: INA Walzlager Schaeffler KG, Fed. Rep. of Germany

[21] Appl. No.: 53,087

[22] Filed: May 22, 1987

Related U.S. Application Data

[63] Continuation of Ser. No. 785,448, Oct. 5, 1985, abandoned.

[30] Foreign Application Priority Data

Oct. 12, 1984 [DE] Fed. Rep. of Germany ..... 3437478

[51] Int. Cl.[4] ..... F01L 1/24

[52] U.S. Cl. ..... 123/90.55; 123/90.51

[58] Field of Search ..... 123/90.51, 90.55, 90.56, 123/90.57, 90.59, 90.43, 90.46

[56] References Cited

U.S. PATENT DOCUMENTS

| | | | |
|---|---|---|---|
| 4,430,970 | 2/1984 | Holtzberg et al. | 123/90.51 |
| 4,437,439 | 3/1984 | Speil | 123/90.56 |
| 4,465,038 | 8/1984 | Speil | 123/90.55 |
| 4,590,898 | 5/1986 | Buente et al. | 123/90.55 |

FOREIGN PATENT DOCUMENTS

| | | | |
|---|---|---|---|
| 2941084 | 4/1981 | Fed. Rep. of Germany | 123/90.55 |

*Primary Examiner*—William R. Cline
*Assistant Examiner*—Peggy Neils
*Attorney, Agent, or Firm*—Bierman & Muserlian

[57] ABSTRACT

A self-adjusting hydraulic valve tappet arranged in a bore of a cylindrical guide bore of a cylinder head of an internal combustion engine and being contacted at one end face by a cam of a shaft and bearing with a second end face against a valve stem, the tappet comprising a cup shaped housing comprised of a hollow cylindrical wall (2) closed at one end by an end member (3) against the outside of which the cam abuts and a cylindrical guide sleeve (6,30,32) concentric with the cylindrical wall (2) and arranged in the center of an annular flange element (5) which at its outer circumference merges into the cylindrical wall (2) of the housing and defines an annular oil reservoir (14) between the cylindrical wall (2) and the cylindrical guide sleeve (6,30,32), the oil reservoir (14) being supplied with oil through a bore (15) leading to the outside of the housing, a self-adjusting hydraulic play compensation element (13) being guided for longitudinal movement in the guide sleeve (6,30,32) and bearing with an end face (25) opposite to the end member (3) against the end of the valve stem, characterized in that the cylindrical guide sleeve (6,30,32) extends to the end member (3) of the housing (1) and contacts the inner face (10) thereof.

11 Claims, 5 Drawing Figures

SELF-ADJUSTING HYDRAULIC VALVE TAPPET

PRIOR APPLICATION

Figure 1:
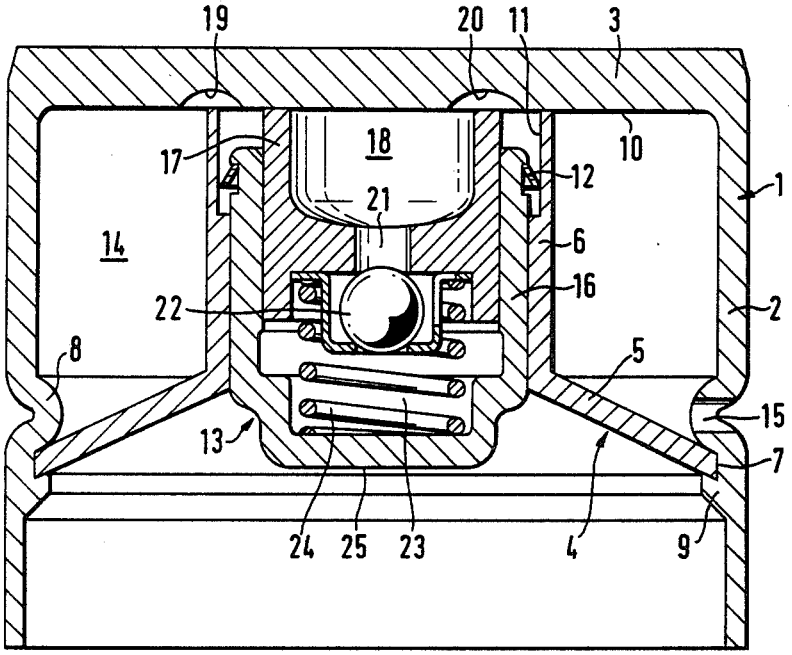

This application is a continuation of copending U.S. patent application Ser. No. 785,448 filed Oct. 5, 1985, now abandoned.

STATE OF THE ART

Self-adjusting hydraulic valve tappets are known from DE-OS No. 33,023,686 wherein play-compensating hydraulic elements formed by an outer piston engaging over an inner piston are used and the pistons are guided one in the other for longitudinal displacement, and together define a high-pressure oil chamber which communicates through a bore closed by a check valve in the inner piston with a central oil reservoir arranged in the inner piston. The said reservoir is defined by the wall of the inner piston and by the inner face of the bottom of the housing against which the inner piston bears by its end face, while the outer piston is mounted for longitudinal displacement in the cylindrical guide sleeve, and bears by its closed end against the end of the valve stem.

In the known valve tappets, the guide sleeve which received the play-compensating element was always of limited axial length, and particularly it always ended at a certain distance from the end member of the housing. Thin walls were always used in such valve tappets to reduce the moving masses and therefor the housings of these tappets were preferably made of drawn sheet metal elements, the inner part consisting of the flange and the guide sleeve could have only a limited stability which due to the occuring oscillations and vibrations could lead to damage or even breakage in long-term operation (DE-OS No. 3,006,644, FIG. 11). To give such tappets an increased mechanical stiffness, they have been made of extruded or cast parts which however entails the disadvantage that thereby their mass is increased with the generally known disadvantages in operation (EP-A No. 0,030,718, FIG. 3).

OBJECTS OF THE INVENTION

It is an object of the invention to provide a self-adjusting hydraulic valve tappet of low mass made of thin-walled metal parts, particularly drawn from sheet metal, and/or from plastic parts, but which has a very high stability and which also has an additional outflow protection for the central oil reservoir, and also may comprise an additional oil reservoir concentrically surrounding the central oil reservoir.

This and other objects and advantages of the invention will become obvious from the following detailed description.

THE INVENTION

In the self-adjusting hydraulic valve tappet of the invention, the tappet is arranged in a bore of a cylindrical guide bore of a cylinder head of an internal combustion engine and being contacted at one end face by a cam of a cam shaft and bearing with a second end face against a valve stem, the tappet comprising a cup shaped housing comprised of a hollow cylindrical wall (2) closed at one end by an end member (3) against the outside of which the cam abuts and a cylindrical guide sleeve (6,30,32) concentric with the cylindrical wall (2) and arranged in the center of an annular flange element (5) which at its outer circumference merges into the cylindrical wall (2) of the housing and defines an annular oil reservoir (14) between the cylindrical wall (2) and the cylindrical guide sleeve (6,30,32), the oil reservoir (14) being supplied with oil through a bore (15) leading to the outside of the housing, a self-adjusting hydraulic play compensating element (13) being guided for the longitudinal movement in the guide sleeve (6,30,32) and bearing with an end face (25) opposite to the end member (3) against the end of the valve stem, characterized in that the cylindrical guide sleeve (6,30,32) extends to the end member (3) of the housing (1) and contacts the inner face (10) thereof.

The problems of the prior art are solved by the cylindrical guide sleeve extending up to the bottom of the housing and contacting the inner face thereof. As compared to known tappets in which the guide ends at a distance from the bottom of the housing, this simple measure achieves increased stability due to the mutual support of a box-type construction even when the wall thickness is clearly less than known designs.

Provisions must be made so that at the end of the cylindrical guide sleeve toward the bottom, oil can pass from the annular oil reservoir into the guide sleeve and hence into the actual self-adjusting element. For this purpose, at least one oil transfer opening may be provided in the region where the cylindrical guide sleeve is in contact with the inner face of the bottom of the housing which is formed by a recess formed at one of the two surfaces in contact with one another. This recess may be in the form of an end slit in the guide sleeve or as a depression or recess in the bottom of the housing.

In the embodiment of the invention, the tappet always consists of two main elements, namely the housing formed by the hollow-cylindrical wall and the end member, and the inner part consisting of the cylindrical guide sleeve and the flange. These two elements may be manufactured as separate parts, e.g. drawn from sheet metal, and may then be firmly joined together at the contact point between the outer edge of the flange and the hollow-cylindrical wall, particularly by a positive or homogenous joint.

It has been found to be expedient to form the inner part consisting of the flange and the cylindrical guide sleeve as a unitary sheet metal part. Alternatively, this inner element may be formed as a unitary plastic element connected with the hollow-cylindrical wall of the housing by a snap-fit, but a modification of this construction is possible in which the inner element consists of a metallic flange and a plastic cylindrical guide sleeve positively connected therewith, particularly snapped in. Lastly, both the flange and the guide sleeve may be made as separate metallic parts which are joined together positively by an additional plastic element, particularly by snapping in.

An additional advantage results if the cylindrical guide sleeve is widened to a larger diameter at its end toward the end member of the housing which forms an additional annular oil reservoir which surrounds the central oil reservoir provided in the self-adjusting element, but which is separate from the outer annular oil reservoir. Even if, when the engine is not operating, this outer annular oil reservoir should run empty, an increased oil supply for the start-up of the engine would be held ready in the additional oil reservoir formed by the widening of the guide sleeve whereby the occurrence of clatter during the start-up phase is avoided with certainty.

When using this measure, it is additionally expedient to provide on the inner face of the end member two separate cutouts or recesses for oil transfer, one of which is in the area of the contact point of the cylindrical guide sleeve and the other in the area of the contact point of the inner piston with the bottom, the two cutouts are diametrically opposite each other. This measure prevents oil from running out of the central oil reservoir in the self-adjusting element during shut off of the engine even if the valve tappet is installed in an inclined position, the reason being that always one of the two oil transfer ports lying one behind the other is in a high location, thereby preventing the leaking out of the oil.

The stability of the tappet construction of the invention can be further enhanced by causing the end of the cylindrical guide sleeve toward the bottom of the housing to engage in a groove in the end member.

Referring now to the drawings:

FIGS. 1 to 5 are longitudinal cross-sectional views through different valve tappets of the invention.

In the embodiment of FIG. 1, the tappet is comprised of cup-shaped housing 1 consisting of hollow cylindrical wall 2 and end member 3 in a single piece. An inner element 4 is formed by annular flange element 5 and cylindrical guide sleeve 6 in this housing. Elements 5 and 6 form an angle greater than 90°. At contact point 7 between the outer circumference of housing 1 and hollow cylindrical wall 2, the said two elements are firmly joined together by flanging. Additional welding, soldering or the like may be provided at this point to ensure a liquid-proof joint. The flange 5 abuts the back of peripheral groove 8 formed in the hollow cylindrical wall 2 and is held against the back of groove 8 by bead 9 formed in cylindrical wall 2.

Cylindrical guide sheeve 6 bears against inner face 10 of end member 3 and in this area, guide sleeve 6 has an increased inner diameter 11 to provide room for cupped ring 12 by which hydraulic play-compensating element 13 is secured against slipping out of the bore of guide sleeve 6. The annular cavity formed by hollow cylindrical wall 2, flange 5, cylindrical guide sleeve 6 and inner face 10 of end member 3 forms an annular oil reservoir 14 which is supplied with oil from the outside by means of bore 15 in peripheral groove 8.

Play-compensating hydraulic element 13 is comprised of outer piston 16 which is slidingly guided in guide sleeve 6 and in turn slidingly receives inner piston 17 with little clearance. Piston 17 has at its end near end member 3 a central oil reservoir 18 which communicates through recesses 19 and 20 in inner face 10 of end member 3 with annular reservoir 14. Oil travels from central oil reservoir 18 via bore 21 closable by check valve 22 into high pressure oil chamber 23 defined by pistons 16 and 17. The said two pistons are forced apart by spring 24. In its installed state, lower end face 25 of outer piston 16 is in contact with the end of the stem of the engine valve while a control cam bears against end member 3 from the outside.

The operation of such a valve tappet is known but in contrast to known designs, the cylindrical guide sleeve 6 of the invention extends up to the inner face 10 of the end member 3 and is supported there for increased stability. This support can be achieved in that upon assembly of cup-shaped housing 1 with inner element 4, the latter is placed under axial pre-stress Another possiblity is to join the two parts together additionally at the contact point between guide sleeve 6 and inner face 10.

Figure 2:
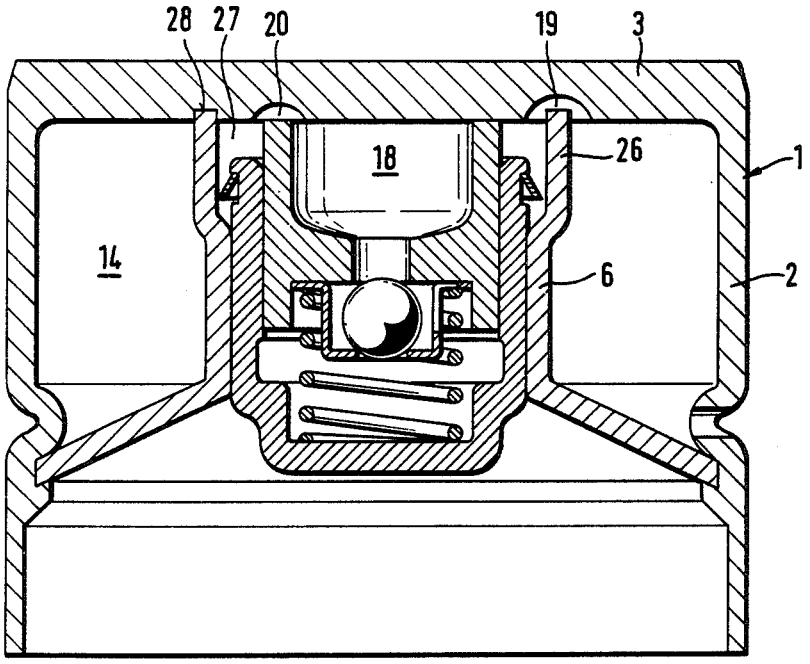

The essential difference between the embodiments of FIG. 2 and FIG. 1 consists in that cylindrical guide sleeve 6 is widened to a larger diameter at its end region 26 toward end member 3 resulting in an additional central annular oil reservoir 27 besides outer annular oil reservoir 14 and central oil reservoir 18. If outer annular oil reservoir 14 runs empty when the engine is not operating, the oil in reservoirs 18 and 27 is retained and is available during start-up of the engine. Because recesses 19 and 20 in end members 3 are arranged at diametrically opposite points, oil reservoir 18 can not run empty even with an inclined installed position of the tappet. The tappet of FIG. 3 has the further special feature that cylindrical guide sleeve 6, or respectively its end region 26 toward the bottom, engages a peripheral groove 28 in end member 3, thereby additionally increasing the stability of the whole tappet.

Figure 3:
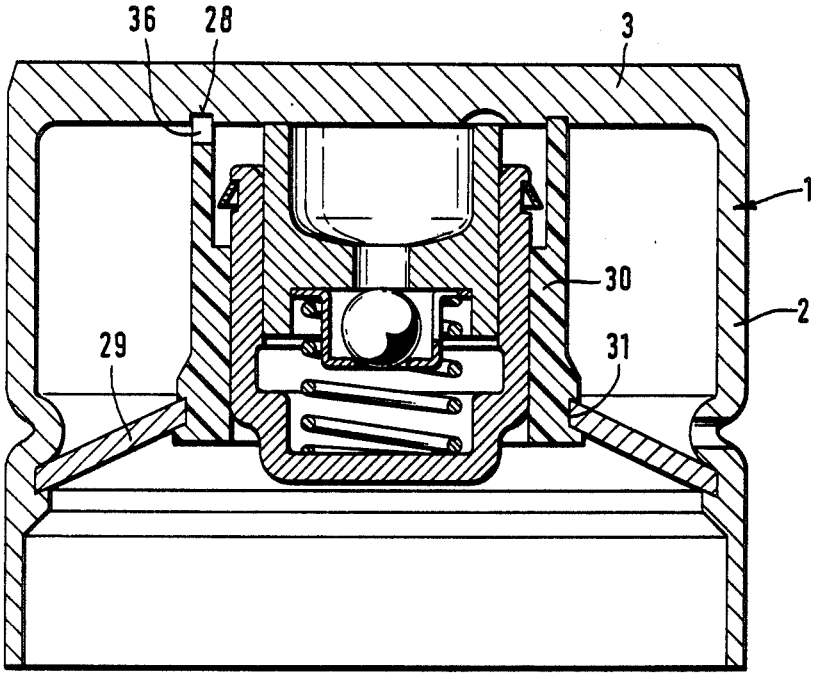

The embodiment of FIG. 3 differs from those of FIGS. 1 and 2 essentially in that although flange 29 is made of metal, cylindrical guide sleeve 30 is made of plastic. Its shape is essentially as in FIG. 1, but its end also engages a peripheral groove 38 in end member 3. Guide sleeve 30 is connected with the flange 29 by snap means 31.

Figure 4:
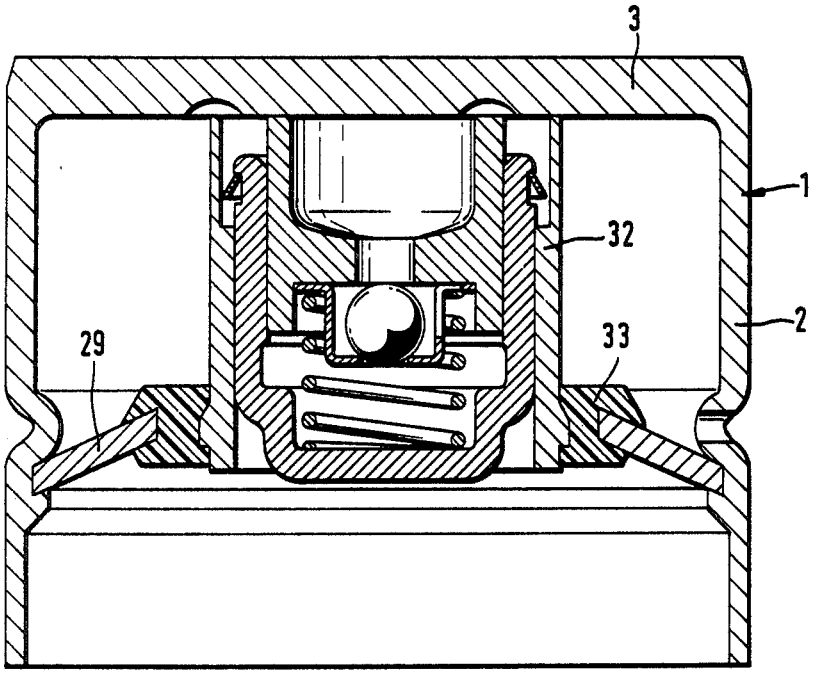

FIG. 4 illustrates an embodiment in which, as in FIG. 3, a metallic flange 29 and a metallic guide sleeve are provided, but they are not made in a single piece, being instead joined together by intermediate plastic element 33.

Figure 5:
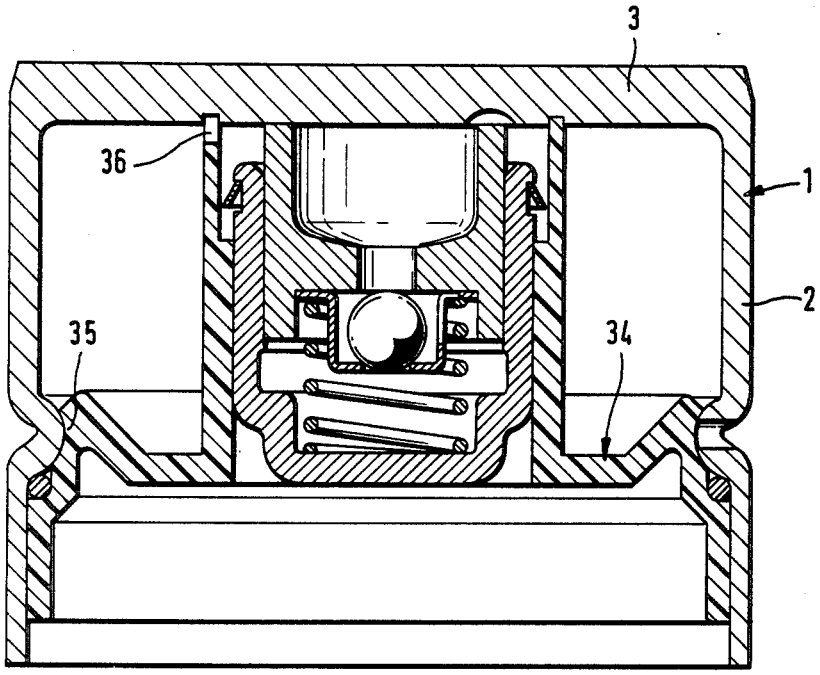

Lastly, FIG. 5 shows an embodiment wherein the entire inner element 34 is formed as a single plastic molded element which is connected with hollow-cylindrical wall 2 of housing 1 by snap means 35.

The embodiments in which plastic elements are used have the advantage not only that these parts are relatively easy to manufacture in any desired form and are low in mass, but also that they are especially well suited to dampen any occuring oscillations and vibrations. As FIGS. 3 and 5 show, for the purpose of oil supply, one or both of the recesses in end member 3 may be replaced by a passage slit 36 provided in guide sleeve 30 or on the inner piston 17 on the end face thereof.

Various modifications of the tappets of the invention may be made without departing from the spirit or scope thereof and it is to be understood that the invention is intended to be limited only as defined in the appended claims.

What we claim is:

1. A self-adjusting hydraulic valve tappet arranged in a bore of a cylindrical guide bore of a cylinder head of an internal combustion engine, the tappet comprising a cup shaped housing comprised of a hollow cylindrical wall closed at one end by an end member against the outside of which a cam of a cam shaft abuts and a cylindrical guide sleeve concentric with the cylindrical wall and arranged in the center of an annular flange element which at its outer circumference merges into the cylindrical wall of the housing and defines an annular oil reservoir between the cylindrical wall, the end member, the cylindrical guide sleeve, and the annular flange element, the oil reservoir being supplied with oil through a bore leading to the outside of the housing, a self-adjusting hydraulic play compensating element being guided for longitudinal movement in the guide sleeve and bearing with an end face opposite to the end member against the end of the valve stem, characterized in that the cylindrical guide sleeve and the annular flange element are made in one piece as a separate part and the cylindrical guide sleeve extends to the end member of the housing and contacts the inner face thereof, whereby the guide sleeve is supported and provides additional stability.

2. A valve tappet of claim 1 with one at least one oil transfer opening provided in the area wherein cylindrical guide sleeve (6,30,32) is in contact with the inner face (10) of end member (3) of housing (1) which opening is formed by cutout (19) in one of the two faces in contact with one another.

3. A valve tappet of claim 1 wherein housing (1) formed by hollow cylindrical wall (2) and end member (3) and the inner element (4,34) comprising guide sleeve (6,30,32) and annular flange (5,29) are made as separate components firmly joined at at least contact point (7) between the outer edge of flange (5,29) and hollow cylindrical wall (2).

4. A valve tappet of claim 3 wherein inner element (4) is made of a one piece sheet metal element.

5. A valve tappet of claim 3 wherein inner element (34) is a one piece plastic molded element connected to hollow cylindrical wall (2) by a snap means (35).

6. A valve tappet of claim 3 wherein inner element (4) is comprised of metallic flange (29) and cylindrical guide sleeve (30) mechanically connected together.

7. A valve tappet of claim 6 wherein the mechanical connection is effected with a snap means.

8. A valve tappet of claim 3 wherein the inner element is comprised of a separate metallic flange (29) and a metallic guide sleeve (32) mechanically joined by plastic element (33).

9. A valve tappet of claim 1 wherein cylindrical guide sleeve (6) is widened to a larger diameter (26) at its end towards end member (3) of housing (1).

10. A valve tappet of claim 2 wherein two separate cutouts (19,20) are provided on the inner surface of end member (3) to provide for oil transfer, one cutout being in the area of the contact point of cylindrical guide sleeve (6,30,32) and the other contact being in the area of the contact point of inner piston (17) with end member (3) and cutouts (19,20) being diametrically opposite each other.

11. A valve tappet of claim 1 wherein the end of cylindrical guide sleeve (6,30) toward end member (3) of housing (1) mechanically engages groove (28) in end member (3).

* * * * *